US012576312B2

(12) United States Patent
Testa et al.

(10) Patent No.: US 12,576,312 B2
(45) Date of Patent: Mar. 17, 2026

(54) DEVICE FOR TRAINING HUMAN'S MOTOR SKILLS AND IN PARTICULAR THE ADAPTATION TO INSTABILITY, THE STRENGTH AND MOBILITY

(71) Applicants: Biomoove Snc, Avigliana (IT); RES Olefine Srl, Monte Gilberto (IT); Bioforce Sas, Blotzheim (FR)

(72) Inventors: Mauro Testa, Avigliana (IT); Romeo Benedetti, Monte Gilberto (IT)

(73) Assignees: BIOMOOVE SNC, Avigliana (IT); SP PLAST CREATING S.R.L., Grottazzolina (IT); BIOFORCE SAS, Blotzheim (FR)

( * ) Notice: Subject to any disclaimer, the term of this patent is extended or adjusted under 35 U.S.C. 154(b) by 0 days.

(21) Appl. No.: 17/904,185

(22) PCT Filed: Feb. 19, 2021

(86) PCT No.: PCT/IB2021/051424

§ 371 (c)(1),
(2) Date: Aug. 12, 2022

(87) PCT Pub. No.: WO2021/165904

PCT Pub. Date: Aug. 26, 2021

(65) Prior Publication Data

US 2023/0085653 A1 Mar. 23, 2023

(30) Foreign Application Priority Data

Feb. 19, 2020 (IT) ..... 102020000003389

(51) Int. Cl.
*A63B 26/00* (2006.01)
*A63B 22/18* (2006.01)

(52) U.S. Cl.
CPC ..... *A63B 26/003* (2013.01); *A63B 22/18* (2013.01); *A63B 2208/0204* (2013.01)

(58) Field of Classification Search
CPC ..... A63B 37/00–43/06
See application file for complete search history.

(56) References Cited

U.S. PATENT DOCUMENTS 3,910,575 A * 10/1975 Miller ..... A63B 63/083 473/447
5,037,084 A * 8/1991 Flor ..... A63B 23/0458 482/52
6,575,885 B1 * 6/2003 Weck ..... A63B 21/0004 482/148
6,740,008 B1 * 5/2004 Ho ..... A63B 22/18 482/79

(Continued)

FOREIGN PATENT DOCUMENTS

WO 2007035776 3/2007
WO WO-2017136701 A1 * 8/2017 ..... A63B 21/0004

*Primary Examiner* — Nyca T Nguyen
(74) *Attorney, Agent, or Firm* — Themis Law

(57) ABSTRACT

A device that trains a person's motor skills, including the adaptation to instability, strength and mobility, includes a dome having preset characteristics of elastic deformability and a wall of preset thickness. One or more separating walls are arranged in an inner recess of the dome and form ribs that provide a support to the dome at its base, defining one or more compartments within the recess.

9 Claims, 10 Drawing Sheets

(56) References Cited

U.S. PATENT DOCUMENTS

| | | | | |
|---|---|---|---|---|
| 6,945,919 | B2 * | 9/2005 | Yang | A63B 22/18 482/141 |
| 7,575,540 | B1 * | 8/2009 | Dobrow | A63B 21/0004 482/142 |
| 8,814,768 | B1 | 8/2014 | Yang | |
| 9,011,295 | B2 * | 4/2015 | Orenstein | A63B 23/0458 482/52 |
| 11,027,170 | B2 * | 6/2021 | Carr | A63B 21/0557 |
| 2009/0215596 | A1 | 8/2009 | Obermaier | |
| 2011/0143896 | A1 * | 6/2011 | Senegal | A63B 4/00 482/146 |
| 2012/0277078 | A1 | 11/2012 | Seade | |
| 2013/0288866 | A1 | 10/2013 | Rainey | |
| 2014/0194258 | A1 * | 7/2014 | Shorter | A63B 21/072 482/93 |
| 2017/0106249 | A1 * | 4/2017 | Marton | A63B 21/00178 |
| 2019/0030395 | A1 * | 1/2019 | Barney | A63B 21/4015 |
| 2019/0175983 | A1 * | 6/2019 | Carr | A63B 22/18 |
| 2020/0368582 | A1 * | 11/2020 | Lin | B29C 41/22 |

* cited by examiner

DEVICE FOR TRAINING HUMAN'S MOTOR SKILLS AND IN PARTICULAR THE ADAPTATION TO INSTABILITY, THE STRENGTH AND MOBILITY

BACKGROUND OF THE INVENTION

The invention refers to a device to train motor skills in humans and in particular to train the adjustment to instability, strength and mobility.

In some embodiments, the invention refers to a combination of parts for the generation of systems to train motor skills in humans and in particular to train the adjustment to instability, strength and mobility.

Furthermore, in some embodiments, the invention refers to various applications to train motor skills in humans and in particular to train the adaptation to instability, strength and mobility, with particular reference to different dynamic and postural conditions and to different activities.

In some embodiments of applications, the invention relates to the use of the device or to a combination of parts according to the above disclosure for applications relating to the construction of supporting or supporting elements for parts or objects which are intended to generate oscillatory or vibrational mechanical stresses and/or which are subjected to mechanical and vibratory or oscillatory stresses generated by other devices.

The first researcher to deal with proprioception, albeit in a very empirical way, was the French neurologist Duchenne of Boulogne (1806-1875) who, with his observations on motor ataxia, discovered the existence of proprioceptive sensations in muscles and joints.

Subsequently, Sherrington's studies in the early 1900s, which created the foundations of modern neurophysiology, have deepened the knowledge above all of medullary reflex responses and subcortical automatic mechanisms related to proprioception.

In 1938 the Swedish Ivar Palmer, orthopedic surgeon, expressed interest in the proprioceptive input of the ligaments.

In 1944 Le Roy Abbott studied the intra-articular structures of the knee, mainly the ligaments, confirming the rich sensory innervation that allows them to be the first line of defense in the kinetic chain.

From the anatomical and histological studies of 1967 by M. A. R. Freeman and B. D. Wike who described the functional instability of the ankle and the relationship between mechanoreceptors and the reflex response of the muscles a long way has been made, many in vivo studies on humans, clinical studies and laboratory research have been carried out.

In August 1997 in Pittsburgh, Pa., 45 experts were brought together for a three-day workshop supported by the American Orthopedic Society for Sports Medicine (AOSSM). From this workshop, a publication for those involved in sports rehabilitation was generated, entitled "Proprioception and Neuromuscular Control in Joint Stability" released in 2000, a work that to date can be considered the most complete on the subject.

What is balance? Balance is the result of a series of exteroceptive and proprioceptive afferents with responses from the effectors (muscles) that allow the projection of the body center of mass to be maintained within the support polygon thus preventing the body from falling.

To keep us in balance, the brain and cerebellum perform many checks on the afferents that reach them through the cranial and peripheral nerves and return motoric efferences suitable for the purpose.

The afferents come from the muscles and tendons through the information sent by the Golgi tendon organs, the Pacini and Ruffini corpuscles and the neuromuscular spindles.

Furthermore, other information comes from the skin of the feet which, through specific receptors, the baroreceptors, send information on the pressure to which each area of the sole of the foot is subjected, from the ligament capsules of the joints that indicate how much they are subjected to forces, from the limbs that provide for indicate its orientation in space, from the optic nerves and the inner ear.

As one can understand, the balance is therefore given by the sum of several factors and, up to now, the best way to increase it is to subject the afferents to important stress in order to always calibrate them at a higher level of difficulty. In other words, it seeks to undermine the proprioceptive system to stimulate it to learn how to solve different situations and how to react more quickly to the intervention of any disturbances in the execution of movements.

There are several useful exercises to increase proprioception and consequently balance. Some provide to send the visual system into a tailspin or to exclude it from the exercises to teach the patient to "feel", that is, to listen to the sensations that come from the various parts of the body.

The international scientific literature is aligned on the fact that training for instability in human beings increases the stability of the same. (The impact of instability resistance training on balance and stability, K Anderson, DG Behm—Sports medicine, 2005—Springer).

In the literature review, it is stated that instability training (proprioception) is able to improve coordination between muscle chains in the agonist/antagonist relationship, promoting joint mobility. The same expressions of muscle strength during movement are favored by good motoric and postural control, therefore by having gained stability through unstable training.

Instability training also has other great advantages on the health of the subject such as an improvement and an increase in the motoric patterns or motoric patterns contained in the motoric cortex and filtered by the subcortical structures. In particular, the cerebellum is the most trainable part with this methodology, and the importance of this structure for the management of human movement is known.

SUMMARY

For the above, according to a first aspect, the present invention is based on a new approach, according to which, instead of training the muscles (the effectors), always different stimuli are created thanks to a training in the central areas responsible for deciding the motoric gesture, therefore a neurological type of training.

The benefit of this new concept does not only apply to the person in orthostatic position, i.e. standing, but also for those who are, for example, sitting or lying down.

One of the aspects that characterize our relationship with the ground is the ground reaction force, that is the force that derives from Newton's third law on dynamics, where for each action or force there is another equal and opposite. So in our walking or running we often face surfaces with different consistencies, the hard surface compared to the sandy or muddy or slippery one requires a different motor control.

Document WO2007/035776 discloses a spherical exercise apparatus comprising two hemispherical, inflatable, flexible elements that can be inflated with fluid or air and joined together to form a spherical object. The flat bases of the hemispherical elements are made with mutual fastening means, allowing a user to perform exercises on a spherical object, or on each hemispherical element. The hemispherical elements include gripping and anti-slip elements on their round surfaces. The device further includes a plate-shaped element which serves as a base for the hemispherical elements when used individually. Alternatively, each hemispherical element can comprise a base element permanently fixed to its flat surface thereof and which base elements comprise means for connecting said hemispherical elements together.

Document US2013/288866A1 discloses an exercise device which comprises a relatively rigid platform supported by a compressible base. The base has a central plane and then tilts outwards and upwards from the central plane following a spherical section. The base allows to obtain instability in height, relative to the angle and the shear deformation movement. The user performs postures and/or exercises using the device under each appendix used for support. The instability triggers the Golgi tendon receptor and the muscle spindle receptor and thus produces physiological benefits. Muscle training devices are available in different sizes and configurations to make up a muscle training system.

Document U.S. Pat. No. 8,814,768 also discloses an exercise device which comprises a base member with an upper surface and a cushion portion extending downwardly therefrom and a recess for a handle and extending downwardly from the upper surface. The cushion portion has a generally convex shape.

US2009215596A1 describes a balancing device, such as a balancing device for dynamic balancing, which is configured in the form of a hollow body that can be filled. The balancing device is equipped with a hollow body with a lower region, an upper region and a lateral region which is connected to the lower region and the upper region by transition regions and which extends between the lower region and the upper region. The hollow body defines at least one chamber, which can be filled with fluid. An outwardly directed flange is disposed externally on the hollow body in the lower region.

US2012277078 discloses a hemispherical exercise device for physical therapy, training and conditioning purposes which comprises an inflatable part and a rotating platform. The inflatable part is attached to the rotating platform.

The concept on which the invention is based is therefore to train or stimulate the central nervous system and then consequently the muscles by modifying the reaction forces to the ground.

In order to obtain the effects described above, the invention provides a first embodiment including the features of independent claim 1.

According to a variant embodiment, the aforesaid dome can have a top opposite to the base side, the top of which is made flattened or flattened according to a plane being secant to the curved surface of the dome.

According to another feature, the dome has an internal recess open on the base side and the base side has an annular or closed supporting surface.

Depending on the use, the dome can be made of different materials with different resilience characteristics. A possible variant embodiment can also provide that the dome is made of two or more different materials with which different parts or areas of the dome are made.

Thanks to the dimensional characteristics of the dome it is possible to vary the deformability and/or resilience characteristics. These dimensional characteristics can also be combined with the choice of the type of material or materials according to the previous embodiment and refer in particular, for example, to the height of the dome, the height being defined as the distance between the point of the external surface of the dome having a greater distance from the base plane, to the dimensions of the base side, i.e. the dimensions in a direction parallel to the said base side and/or also to the thickness of the wall of the said dome.

The characteristics of resilience, deformability and/or elasticity can also be influenced by the configuration of the separation walls of the internal compartments, in relation to their thickness and/or the material they are made of and/or also in relation to their distance or shape. The size of the compartments generated by the said separation walls can also vary in order to influence the resilient behavior of the dome.

According to a further embodiment of the invention which can also include one or more of the characteristics of the previous embodiments in any combination and/or sub-combination, the compartments of the internal part of the dome delimited by the separation walls and, along the perimeter, also by the dome wall itself, can have different shapes which are defined by the shape of the separation walls.

Preferably, said compartments have a cross section of polygonal shape, that is a polygonal shape of the section according to a plane parallel to the plane defined by the base side of the dome.

A preferred embodiment provides that said dome has a regular and rotationally symmetrical shape or is constituted by a sphere sector, preferably by a hemisphere. However, this shape constitutes a choice of a specific embodiment that should not be considered limiting and should not exclude other shapes such as ovoid or elliptical or elongated shapes.

According to yet another variant embodiment, which can be provided in any combination or sub-combination with the aforementioned embodiments, the compartments into which the internal recess of the dome is divided can have different sizes both, in relation to their size in a direction perpendicular to the underlying plane defined by the base side and relation to the size in a direction parallel to said plane defined by the said base side.

It is possible to envisage different distribution models of the said compartments in relation to their dimensional configuration within the recess of the dome.

An executive form provides a distribution model that is symmetrical in rotation with respect to the axis of symmetry of the dome which dome is also preferably symmetrical in rotation with respect to the same axis.

Still according to an embodiment, the dome provides inside the recess a central wall coaxial with respect to the axis of symmetry of the dome and which defines a coaxial, central space of greater dimensions around which they are distributed on at least one annular band or on several concentric annular bands and additional compartments of smaller dimensions, identical and/or different from each other between one of the annular bands and another of the annular bands.

A variant embodiment provides that the central compartment is filled with material optionally of material different from that of the separation walls that delimit it or of the same material as said walls and/or that the filling material and the separation walls are made of a single piece.

According to yet another feature, the compartments into which the hollow part of the dome is divided, i.e. the internal recess, have an hexagonal cross-section and consequently also the separation walls that delimit the said compartments are made in the manner of closed mantle walls and with hexagonal cross section.

An embodiment provides that the subdivision compartments of the internal recess of the dome provided in the band directly internal to the perimeter edge of the dome at the base side have a different shape compared to the compartments and the corresponding separation walls provided for the innermost compartments of the dome, being a delimitation wall of the said rooms constituted by the wall of the dome itself.

The recesses in the internal part of the dome can have various shapes and that of the executive example envisaged as hexagonal allows the dome to be deformed multi laterally.

To improve the vertical and lateral deformability, a different shape of grooves and edges inside the dome has been provided. The hexagonal grooves are defined by separation walls with an edge that is no longer uniformly adherent throughout its extension to the support surface but only in some points, while others are low with respect to the edge. In addition, the central part of the dome itself is raised towards the top of the dome and thus lowered with respect to the support surface of the edge of the dome itself.

According to a further embodiment, in combination with a dome according to one or more any of the previous embodiments and variants, in combination with the aforementioned dome part, a male element is provided for filling and/or closing at least partially the internal recess of the dome at the base side thereof and which optionally forms a base plane of the dome itself, said base element comprising a base plate having a shape essentially at least corresponding to the perimetral shape of the base side of the dome, which base plate has projections projecting towards and into the internal space of the dome of such size and shape as to cooperate with at least part of the internal surfaces of the dome wall.

One embodiment provides that the perimeter edge of the base plate can extend beyond the perimeter edge of the base side of the dome. An executive variant instead provides that the said perimeter edge of the base plate of the base element extends flush with the perimeter edge of the base side of the dome.

According to another characteristic, the projections projecting from the base plate of the male base element are made at for a part thereof coinciding with corresponding subdivision compartments of the internal recess of the dome which are delimited by the separation walls, having transversal dimensions and shape such to be engaged in the corresponding compartment in contact with the internal surfaces of the separation and delimiting walls of said corresponding compartment by means of shape coupling.

In the axial direction of said compartments, the corresponding projections can extend for the entire axial extension of the corresponding compartment ending with a head side that adheres in contact with the internal surface of the wall part of the dome coinciding with said compartment.

According to a variant embodiment, at least some projections in correspondence with at least some compartments extend only for part of the axial depth of the corresponding compartment and/or some projections at some compartments may be completely missing or omitted.

In a variant embodiment the said projections are made of a shape and size corresponding substantially exactly to the shape and size of the corresponding compartment and the base element has a projection for each compartment subdividing of the internal recess of the dome.

According to a further embodiment which can be provided in combination with one or more any of the executive forms and executive variants envisaged for the dome, in combination with this dome the invention provides for a coupling element of two domes in opposite positions, that is, with the respective base sides facing each other.

In one embodiment, the said coupling element has a base plate intended to close the mutually opposite base sides of the two domes and which adheres against the said base sides with one of its two faces respectively, while from each face of the base plate, protrusions branch off towards the inside of the dome, which protrusions at least partially penetrate inside the compartments into which the cavities of the two domes are divided and at least partially have identical shape and identical size of at least some of said compartments.

It is possible that the coupling element has one or more of the characteristics provided for the male base element referred to above and this in any combination and sub-combination.

According to another embodiment, the two opposing domes can be identical or different as regards the shape and/or one or more of the dimensions of the dome and/or of the walls of the dome and/or of the separation walls and therefore of the compartments in which the internal recess of the said domes is divided.

With reference to a further embodiment, the two domes are identical in shape and size and also the base plate of the coupling element has a plan shape corresponding to that of the two base sides of the two domes, thus the peripheral edge of the base side of the two domes and the peripheral edge of the base plate of the coupling element extending flush with each other and completing each other so as to constitute a three-dimensional surface closed on itself and essentially spherical, elliptical or in any case curved.

With reference to the aforementioned variants relating to the male element and the coupling element, the domes as well as the male or double male can be built with different shapes and materials with different softness, taking advantage of the entire Shore scale on the hardness of the materials. Therefore, the variability of the consistency of the materials making up the invention as well as the different possible configurations amplify the possibilities of varying the elastic response of the combination of domes and male element or domes and coupling element to allow to generate stimuli and to train or rehabilitate the subject in a diversified way and corresponding to the targets.

In particular, by varying the thickness of the base plate of the male element or the coupling element, it is possible to vary the height of the combination of the dome and the male element or of the two domes and the coupling element.

According to yet another feature, an embodiment provides for a combination of at least one dome with at least one male element-according to one or more of the previous embodiments and executive variants and in any combination or sub-combination with a rotation support of said dome together to said male element around an axis perpendicular to the base plate of the male element and/or to the base side of said dome.

Alternatively, a variant embodiment provides for a combination of at least two opposing domes joined by a coupling element which is made according to one or more of the previous embodiments and variants and in any combination or sub-combination thereof, the said combination being with a rotation support of said dome together with the said male element around an axis perpendicular to the base plate of the male element and/or to the base side of said dome.

In both cases described above, the said rotation support consists of two supports rotatably fixed to each other according to an axis parallel to the desired rotation axis and which two supports are fixed stably, or in a way that cannot be moved relative to them, respectively one with said male element and/or with the dome, respectively in the case of the combination of a dome with a male element and in the case of the combination of two opposing domes joined together by a coupling element.

According to an embodiment, said two supports have cooperating members for limiting the angle of rotation.

One embodiment provides that said members for limiting the angle of rotation are constituted by an annular groove concentric with respect to the axis of rotation and which has a certain angular extension and is obtained in one face of one of the two supports and with which groove cooperates with a projection, projecting from the other of the two supports from the face facing the said first support and which is intended to move in the said groove provided on the first support, being the distance of the said projection from the axis of rotation corresponding to the radius of the said groove annular.

One embodiment provides that the two supports are in the shape of a truncated cone disc with an obtuse opening angle and that the major base of the two supports is fixed respectively to the combination of dome and male element or to the arrangement of two opposing domes and an element of coupling, the major base of the other support being intended to form the support side of the said support to a support surface, while the two supports are rotatably fixed to each other with the smaller bases in contact with each other.

It is clear that said supports can be made with any shape in plan and that a preferred solution provides that it is in the form of discs coaxial to the rotation axis.

From the foregoing it is evident that the invention, with its versatility allows to be applied in different fields which may be the following:

Sports and rehabilitation world

For all aspects related to the development of balance skills, development of muscle strength in a context of instability, work on joint mobility by combining the other skills;

World of comfort and cushioning

Additional element within the padding, elements for improving functionality while sitting, lying down and standing (e.g. mattresses, sofas, surfaces in which the domes are joined together and not separated);

World of footwear (one can insert the smallest dome (A) in the sole, causing the instability of support typical of the bare foot);

Insertion of domes of different sizes in the rear foot and in the forefoot of the shoe in order to improve functionality in static and dynamic thanks to the controlled imbalance;

Support in flooring, as an anti-trauma and instability solution

In sports floors, eg in basketball under wood as a buffer, or in those with heavy traffic or in those for people who work on their feet all day.

Feet in various structures for creating unstable products.

Unstable feet for chairs, beds, sofas, etc.

World of ergonomics and functionality.

Under or interspersed with rigid structures, eg between the seat and the spokes of an office chair or between the backrest and its base to determine a better adaptation of the environment to humans and a respectful functionality of the same.

World of anti-vibration and anti-noise

Due to its structure, the device has the ability to absorb noise and vibrations.

The invention according to one or more of the embodiments of the present invention can also be used as a support foot for room training devices or structures, such as treadmills, exercise bikes, rowing machines, steppers and other similar tools.

The great versatility of the invention allows it to develop from it a huge variety of innovative products with a high impact on well-being, the philosophy in each of them is to increase balance and stability through instability.

In current proprioceptive training, the athlete is normally in static instability, i.e. there is no displacement of the load.

In everyday life when we walk or run we shift our weight in the direction of travel and we decrease our support polygon because physiologically we only use a portion of the foot.

The new invention uses the same principle and is able to reproduce, in instability, any motor pattern.

The embodiment with the two lenticular supports centrally constrained by a screw and without domes or male connectors can be used as a structure to free joints from functional limitations, for example the subject places his foot on it with the knee extended and rotating the foot internally or externally frees the hip from muscle tendon limitations. This in sport represents a determining factor for the prevention of injuries.

BRIEF DESCRIPTION OF THE DRAWINGS

The invention will become clearer from the following description of some non-imitative executive examples illustrated in the attached drawings, in which.

DETAILED DESCRIPTION OF THE EXECUTIVE FORMS SHOWN IN THE FIGURES

With reference to the following description, it must be considered that the illustrated embodiments are purely by way of example and do not constitute any limitation to the more general inventive teaching claimed below, but are only examples of implementation of said teachings.

With reference to FIGS. 1 to 4, the device according to the invention comprises one or more hemispheres or domes A, with a flat base side 1 which is constituted by the annular edge of the delimiting wall of the dome A.

The dome can have different heights as indicated with 3, that is different extensions along a central axis or of symmetry axis X which is perpendicular to the plane subtended by the base side 2. In combination with the said height dimensions, the dome can also have different dimensions with respect to the radius of the base side 2 and/or the thickness of the wall and/or, as indicated in the figures, a flattening at the top.

According to an embodiment, said flattening can be of different sizes and/or can also be rotationally symmetrical and centered with respect to the central axis or the axis X of symmetry. In this case, the flattening may have a different length of the radius R.

Figure 2:
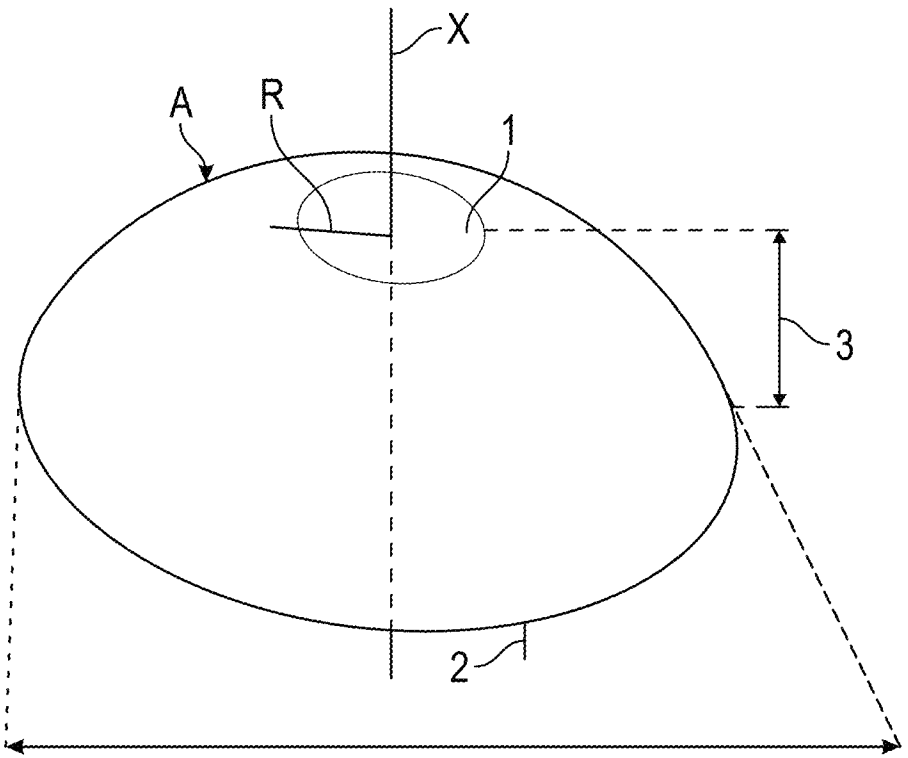
FIGS. 1 and 2 show two embodiments of a dome element according to the present invention having different shape and different dimensions.
Figure 1:
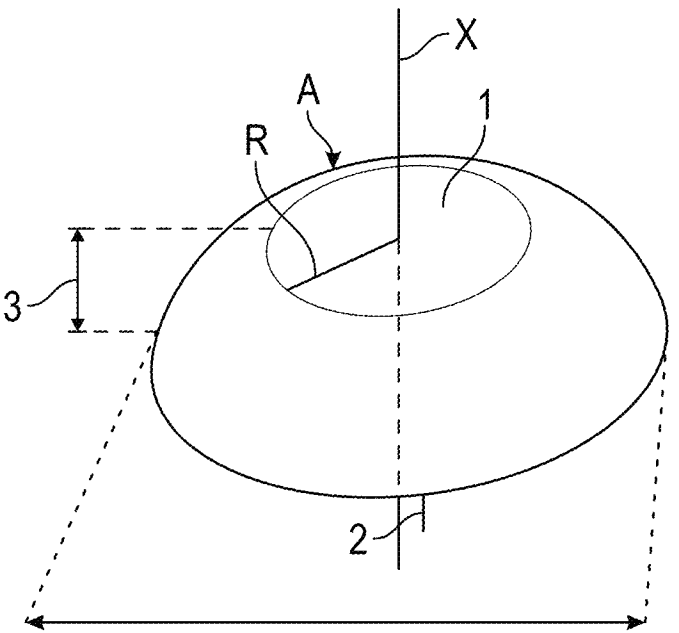
Figure 4:
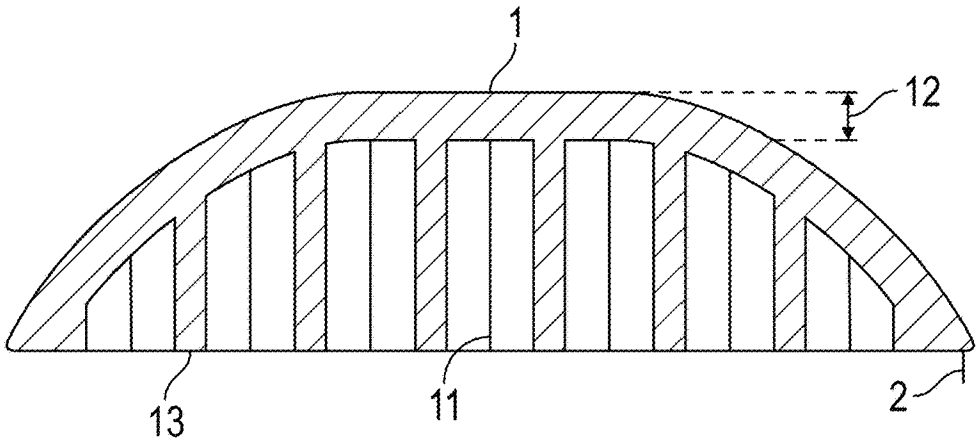
FIGS. 3 and 4 show a section view according to a plane perpendicular to the base side and containing the central axis of the two domes of FIGS. 1 and 2 respectively.
Figure 3:
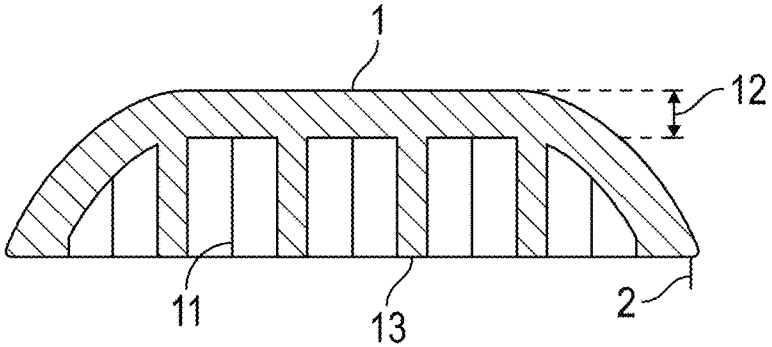

As shown in FIGS. 3 and 4, the dome has a concave side which defines a lower cavity 11, which is divided by a plurality of separation walls 13 into compartments of predetermined dimensions.

Figure 5:
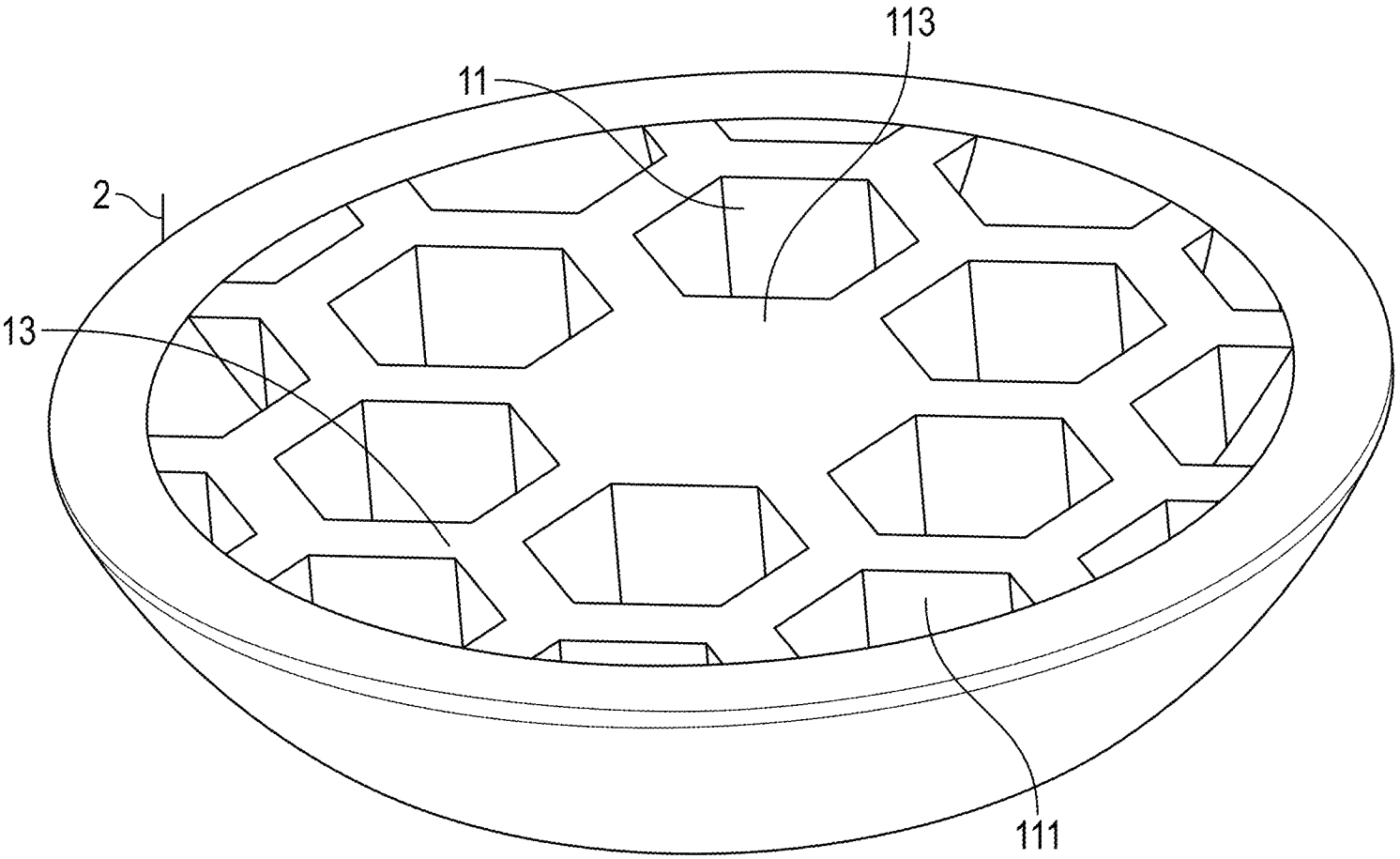
FIG. 5 shows a first embodiment of the cavity of a dome divided into a plurality of chambers.

The hollow compartments 11 are of different shape and size as well as the separation walls 13 which can have different shapes and sizes also depending on the intended use of the dome according to FIGS. 3 and 4 and 5.

In the illustrated embodiment, the separation walls 13 form a network of walls which intersect each other forming a set of closed compartments 11.

In the illustrated embodiment, the closed compartments 13 and the walls have a cross-sectional shape which is hexagonal.

The separation walls 11 with different thicknesses allow to give and characterize different elastic behaviors of the dome A. The wall of the dome A can also be more or less thick to ensure optimal deformability of the dome itself.

It should however be considered that the invention may have such hollow parts or be deprived of them.

The compartments 11 in the internal part of the dome A can have various shapes, the hexagonal one illustrated has some advantages and is a preferred, albeit non-limiting, shape because it is capable of deforming along to multiple sides.

As is evident from the figures, when the dome has a rotationally symmetrical shape, i.e. it is made up of a sector of a sphere, the arrangement of the compartments 11 substantially corresponds to rotational symmetry, with a central hexagon coaxial with the axis of symmetry surrounded from rings of hexagonal compartments up to a last outermost ring which is delimited on the outward side of the dome A by the peripheral wall of the dome A and is also formed by partial hexagonal compartments, indicated with 111 in FIG. 5, or by compartments which are sectors of a hexagonal compartment as they are cut from the wall of the dome A.

The thickness of the wall of the dome A in correspondence with the base side can be different from the wall thickness for the remaining extension and sufficiently large to guarantee a good support on the ground and a good anti-slip effect towards the flooring.

In the embodiment of FIG. 5 it has been chosen to provide that the central hexagon 113 is not hollow, but is solid forming a large central support surface of the dome A. This solution is entirely exemplary and should not be construed as a limitation.

Figure 6:
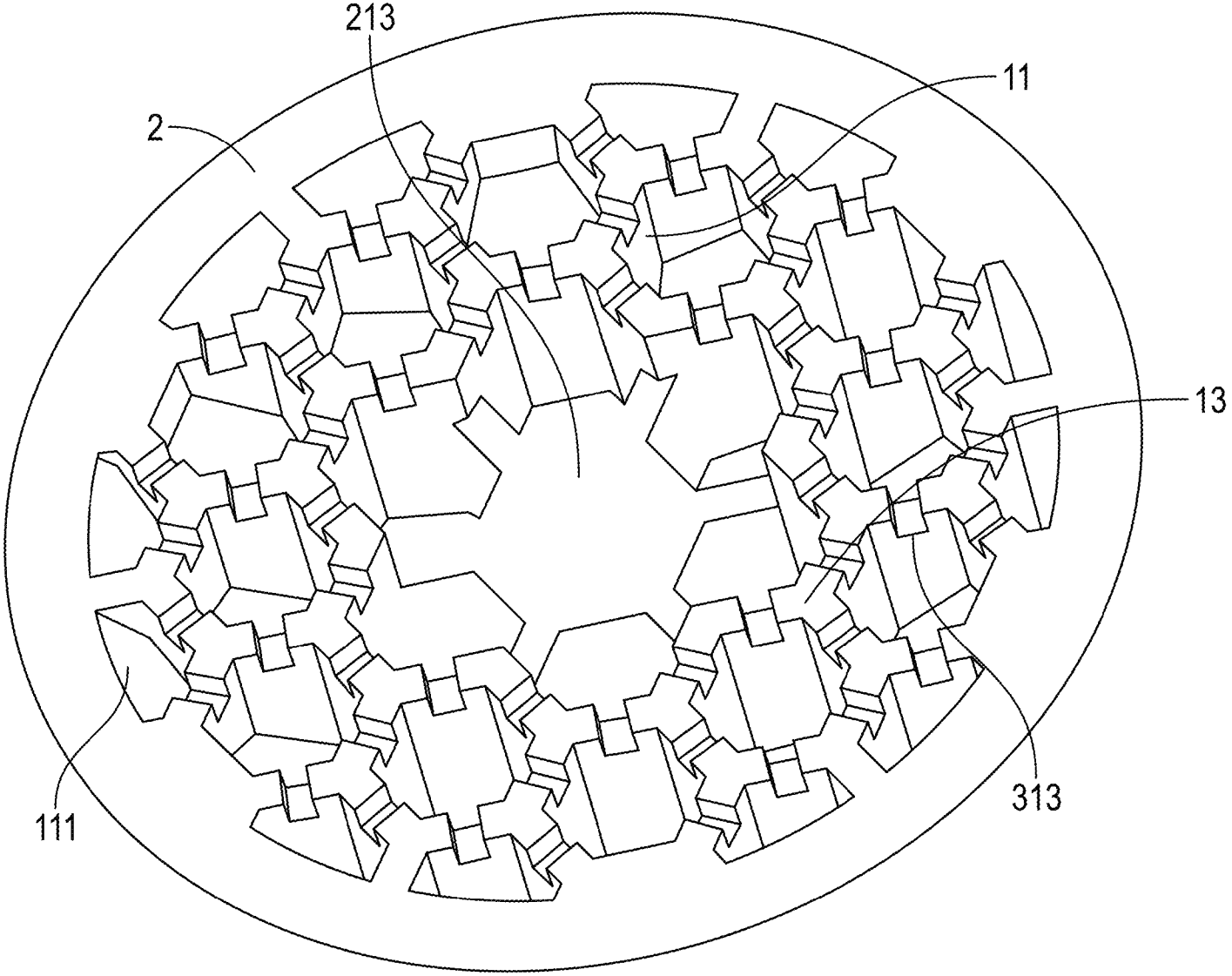
FIG. 6 shows a second embodiment of the recess of a dome divided into a plurality of chambers and in which the separation walls and recesses have different depths.

As is evident from FIG. 6 instead, the central hexagon indicated here with 213 can be hollow.

Figure 7:
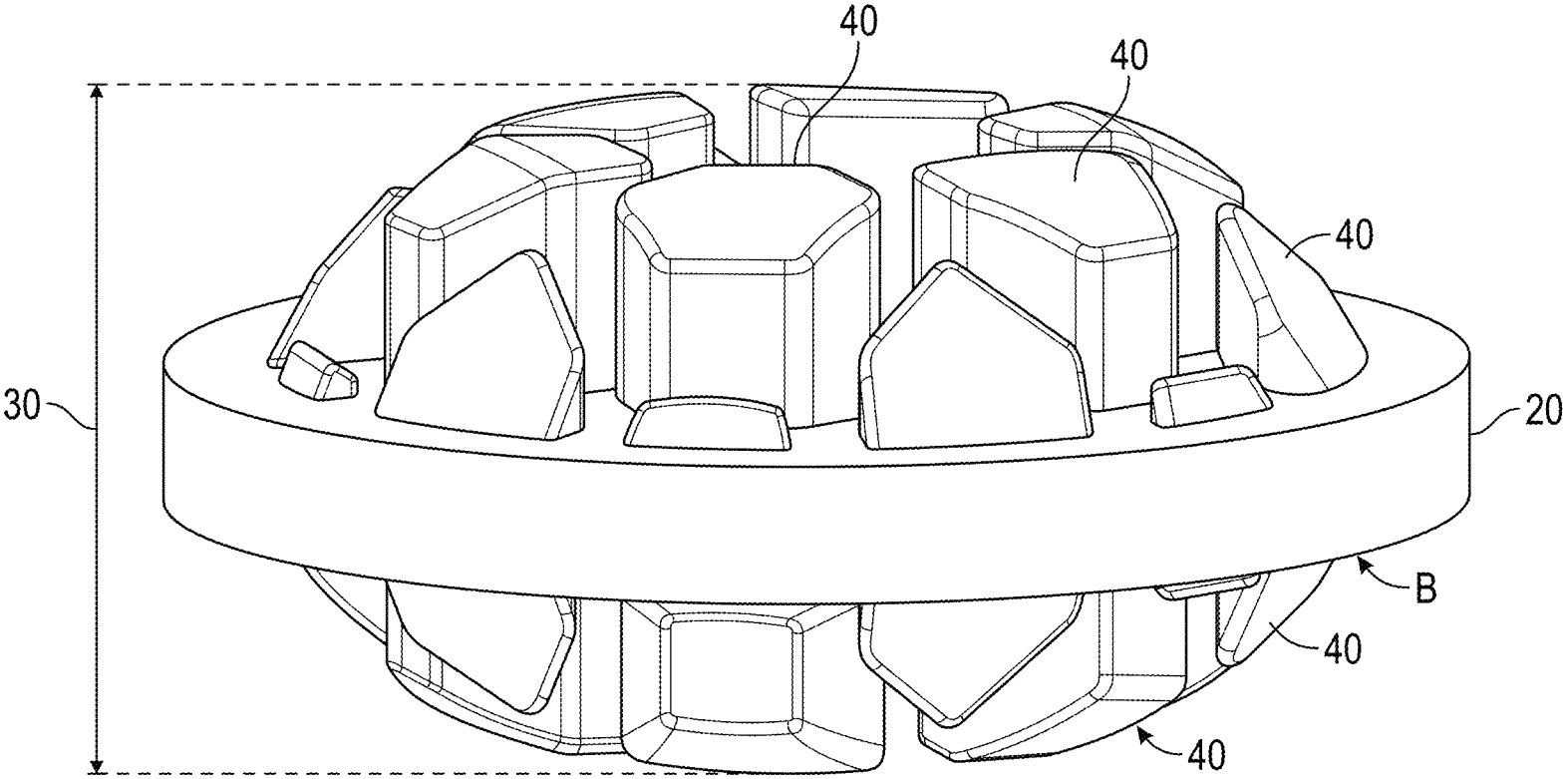
FIG. 7 shows a perspective view of a coupling element of two domes opposite one to the other and according to the previous figures.

The separation walls 13 can have such a length that they do not end for their entire length flush with the edge of the dome A on the base side of the same. As shown in FIG. 5, the edges of the separation walls 13 are at the level of the edge of the dome and can be constructed with different thicknesses to ensure different biomechanical behaviors. However, as shown in FIG. 7, to improve the vertical and lateral deformability it is possible to provide a different shape of recesses and edges inside the dome A. As can be seen in FIG. 7, the hexagonal compartments 11 are defined by a wall 13 with an edge that it is no longer uniformly with the support plane but only in some points, while other points 313 are re-entering with respect to the plane subtended by the edge of the dome A coinciding with the base plane of the same.

According to another feature that can be provided in combination or separately with the above and with one or more of the previous embodiments, the depth of the compartments 11 can vary and may not reach the wall of the dome A at the innermost end, i.e. they may not be closed from said wall of the dome A. In FIG. 6, the bottom side of the central compartment 213 has been spaced from the top of the dome and therefore the depth of the compartment with respect to the base plane of the dome is less than that possible.

Figure 9:
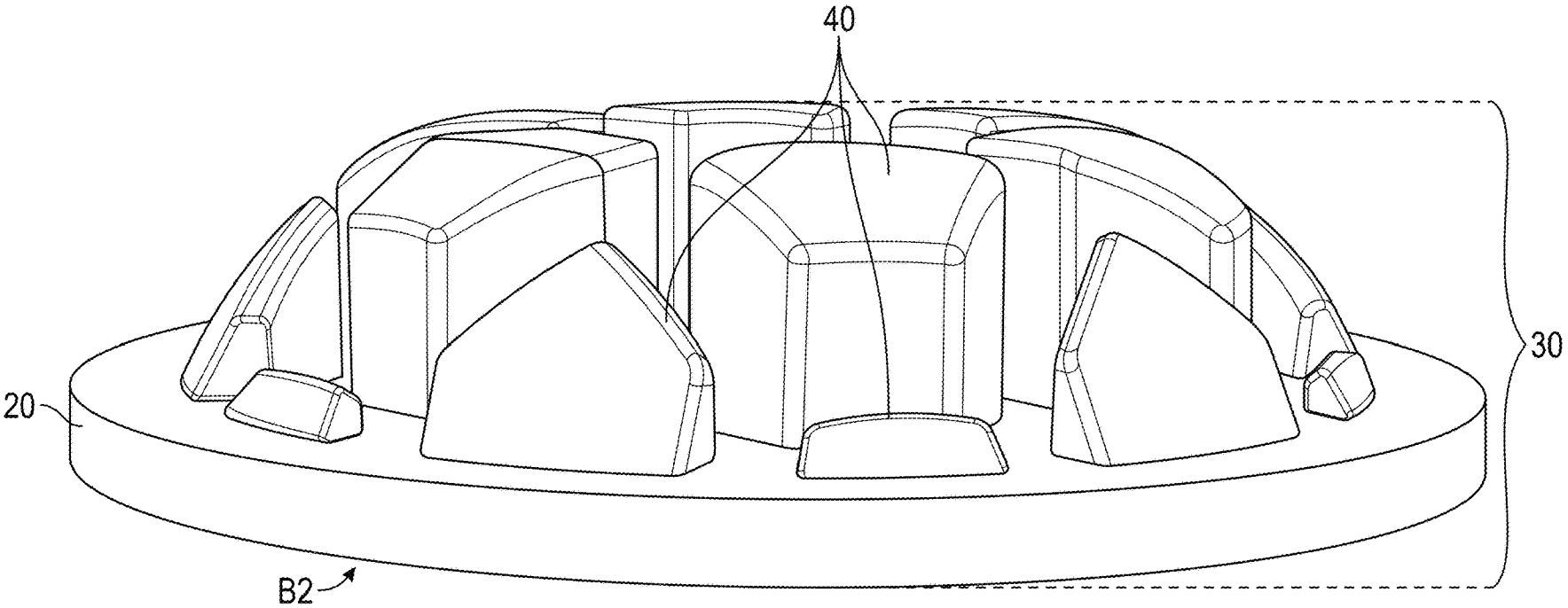
FIG. 9 shows a perspective view of a male base element of a dome according to one of the previous figures.

With reference to FIGS. 7 and 9, according to yet another feature, a single dome A or two domes A can be provided in combination with a male element which in the case of a single dome A constitutes a closing or filling element of the recess from the base side, while in the case of two or more domes A constitutes a coupling element of said two or more domes.

Figure 8:
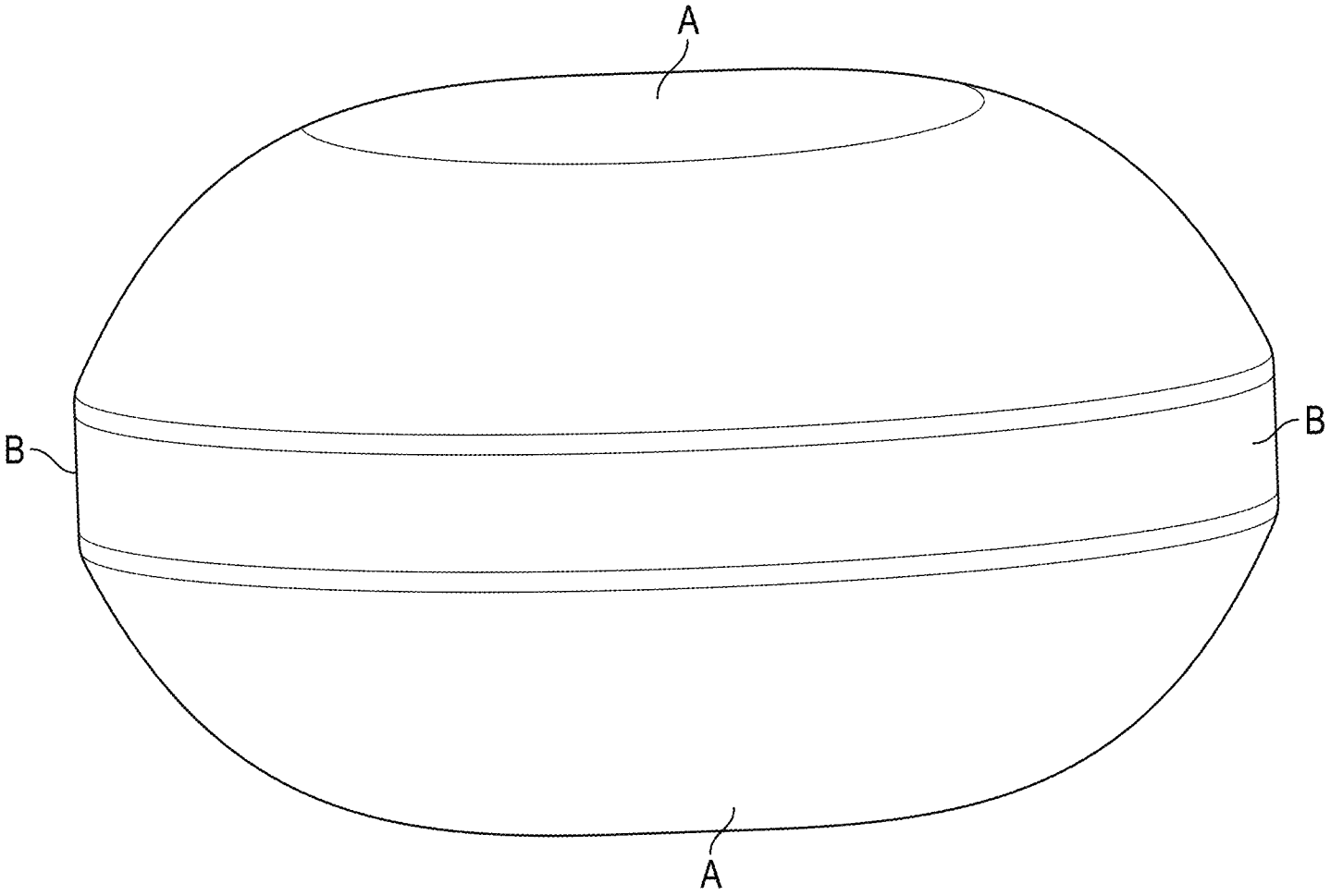
FIG. 8 shows a perspective view of two domes according to the previous figures in a condition coupled together by means of a coupling element according to FIG. 7.

FIG. 8 shows an embodiment in which the said coupling element indicated with B in FIG. 7 connects together in a congruent and opposite position, or with the respective base sides facing each other, two domes A.

The coupling element B of FIG. 7 has a base plate 20 from which projections 40 branch off intended to engage at least for a part in the recess of the two opposing domes A, or in at least part of the compartments 11 in which said recesses are subdivided.

With reference to the illustrated embodiment, the coupling element B has on each side of the base plate 20 a plurality of projections of such shape and arranged in positions such as to engage in a respective compartment 11 of the corresponding dome 11, filling it entirely and coupling with shape coupling with the separation walls 13 of said compartments 11.

It is clear that, in order to calibrate the elastic response of the combination of said two opposing domes A and of the coupling element B, it is possible to take different configurations of the projections which some of them may completely fill the corresponding compartment 11 or some of them may only partially fill or some of them may be not present.

It is also evident that the base plate and/or at least part or all of the projections can be made in a single piece, of the same material, or from different materials, at least for a part of said projections and of the base plate, which different materials can be made as parts fixed together after forming or as parts obtained from multi-material molding and can also be different from each other relating to the projections present on the two faces of the base plate so as to have different responses of the two opposing domes connected by the coupling element.

In the embodiment illustrated in FIGS. 7 and 8, the coupling element B has a height 30 which is equal to the sum of the maximum depths of the two opposing domes.

Without for this constituting a combination of essential characteristics that limits the scope of protection, but considering the characteristic as a pure example, the embodiment of FIG. 8 includes two domes A which are identical in shape and size and which are connected by a coupling element B whose base plate 20 is perfectly congruent, i.e. it extends flush with the edge of the two domes at the base side.

Still according to a further variant, instead of having two identical domes or a coupling element with a base plate 20 perfectly congruent with the outer edges of the base side of the domes A, the two domes A can be different from each other both relatively to one or more dimensions, such as height 3 or radius R and/or relatively to the shape and/or relatively to the material.

Furthermore, as regards the coupling element, the base plate can extend beyond the peripheral edge of the base side of one or both domes and have a different plan shape from one or both base sides.

According to yet another possible variant of the coupling element B, unlike the one illustrated in FIGS. 7 and 8 which allows two domes A to be coupled together in opposite positions, forming a solid with a closed and rounded shape, or a sort of spheroid which can have any irregular or regular shape, that is elliptical, or spherical or partially symmetrical in rotation according to only some axes, it is possible that the base plate 20 has groups of projections 40 provided at a certain distance and each destined to couple with the recess of a respective dome A. In this case the groups of projections are on the same side of the base plate and a corresponding dome A is coupled to them. Therefore, the coupling element allows to have on a single base plate 20 and on the same side several domes A joined together by the same coupling element.

A further variant embodiment can provide two or more domes A coupled together to a common base plate 20 of a coupling element and arranged respectively on both sides of said base plate 20. Therefore, each side of the base plate carries a plurality of domes A distributed along its extension.

Still according to a possible variant embodiment, the domes A on one side can all coincide with a dome A on the opposite side of the base plate or the domes A on one side of the base plate can all be provided offset or not coincident with the domes A on the opposite side of the base plate.

A further alternative provides that at least a part of the domes on one side of the base plate is expected to coincide and a part of that does not coincide with at least a part of the domes on the opposite side of the base plate.

This embodiment allows to realize mats or stable distributions of devices according to the present invention which can find a use for example in the production of soles or insoles for shoes or in the production of panels or mats of elastic support, allowing to calibrate the elastic response in a way differentiated for different areas of the extension of a support or contact surface.

FIG. 9 shows a further embodiment, in which a male element B2 shows the ridges 40 only on one side of the base plate 20.

In relation to this executive example, one or more of the variations of shape and material provided for the coupling element are to be considered applicable to this embodiment to the extent that these are obviously applicable.

These executive variants will not be described again in relation to example B2 of FIG. 9 as they have been already described above and are directly applicable without any inventive effort to the embodiment of FIG. 9.

As already mentioned above, this embodiment of FIG. 9 allows to couple the dome element that characterizes the device according to the present invention to a flat structure. In relation to the variant described above in which the same base plate 20 carries several domes distributed according to a desired design, the embodiment B2 allows said domes to be connected to a plane or flat or substantially plane or flat structure.

Figure 10:
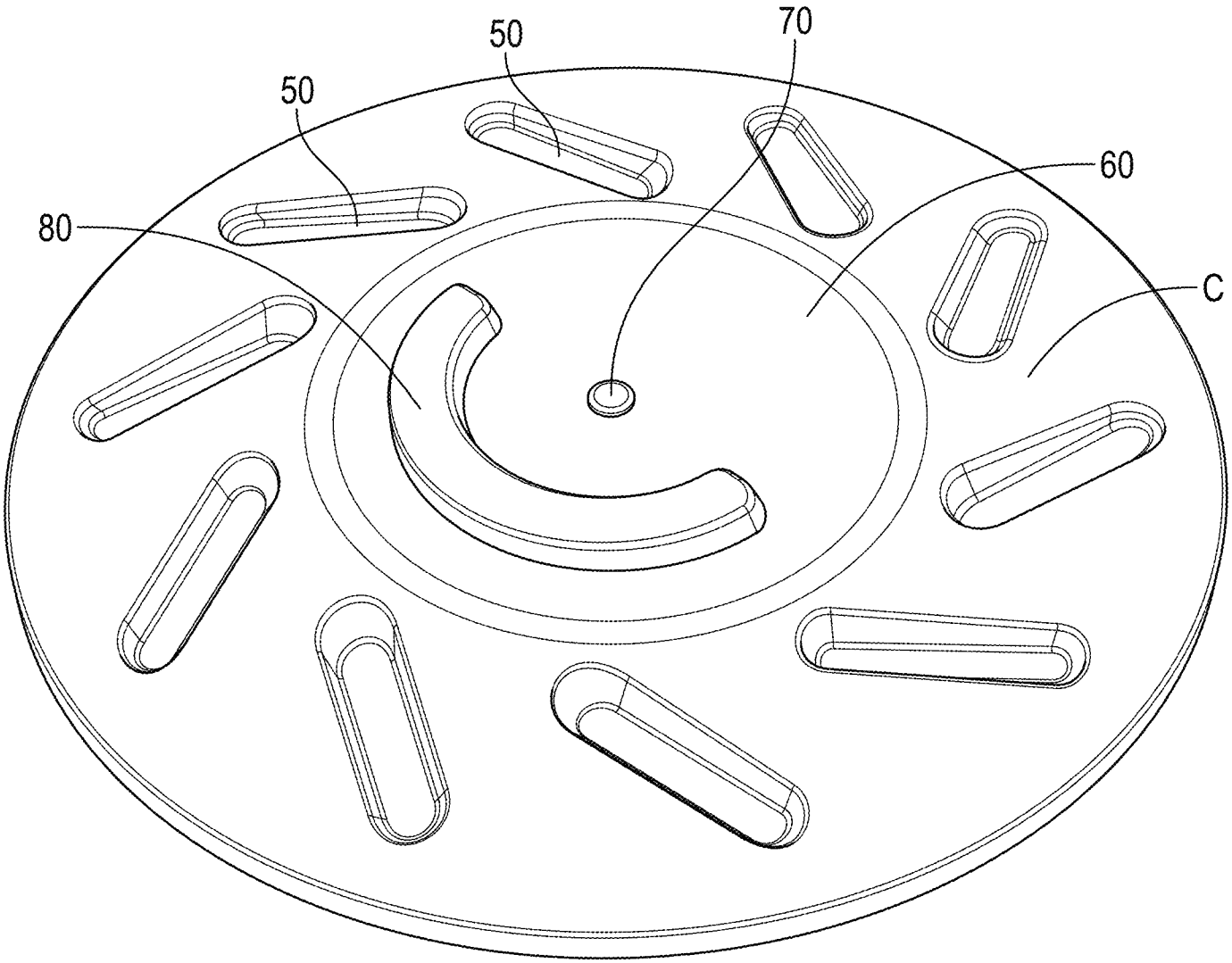
FIGS. 10 and 11 separately show a perspective view of two elements which form a revolving support of a dome or a combination of domes and/or with a male element and/or with a coupling element according to one or more of the previous figures.
Figure 11:
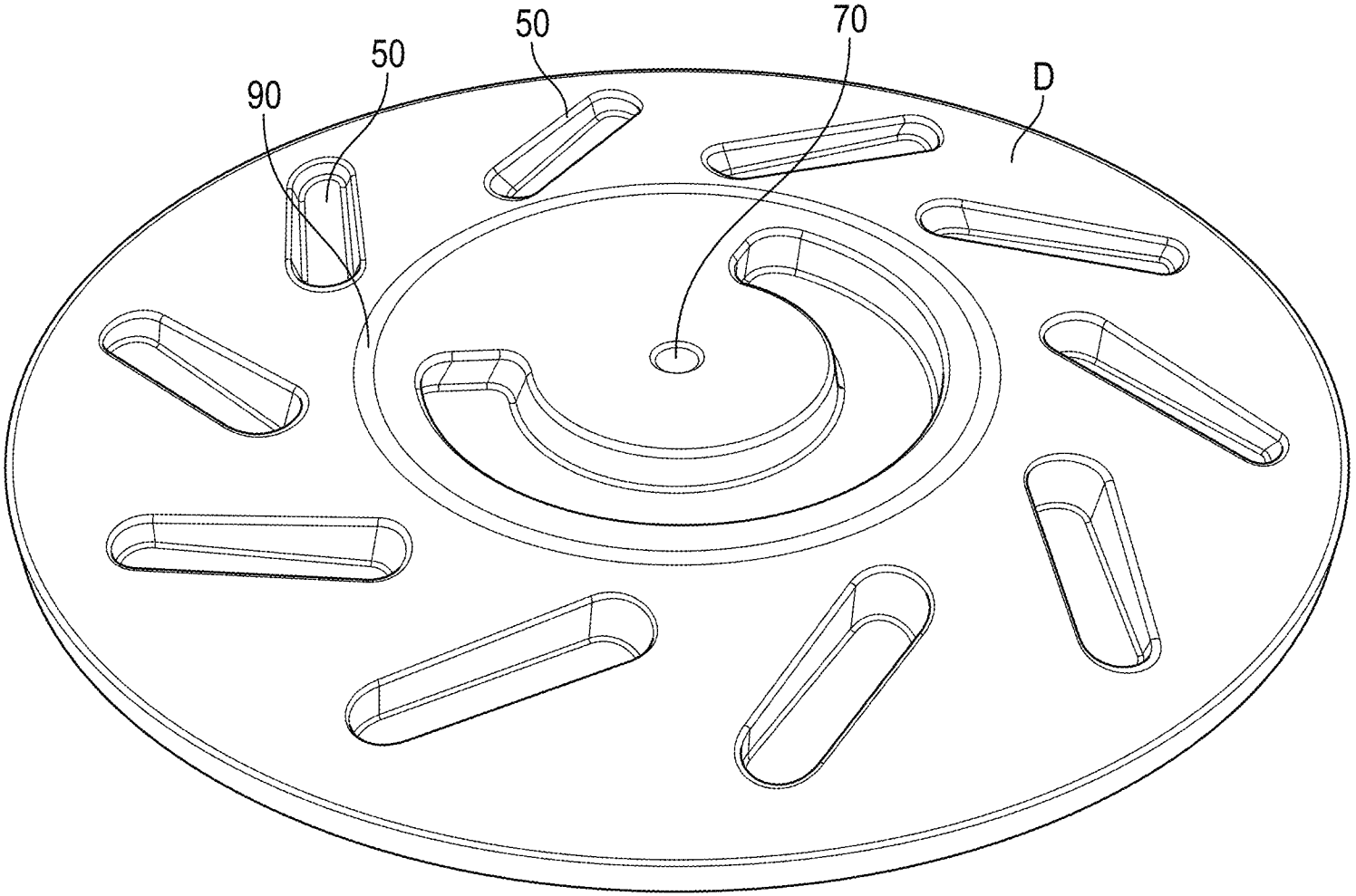

FIGS. 10 and 11 each show one of two elements of a rotatable support for a device according to any of the embodiments or variants described above.

The revolving support device is formed by two connecting plates C and D which are intended to be rotatably coupled in a position side by side thanks to a shaft (not shown) constituted for example by a screw or a bolt being provided with an engagement hole 70 of said screw or bolt.

According to an embodiment, the two plates C and D, preferably disc-shaped and rotationally symmetrical with respect to the reciprocal rotation axis, have an angular rotation limiter of one plate relative to the other which is intended to allow reciprocal rotation for a certain angle such as, for example, at most for an angle of 360°.

An executive variant of the rotating support can provide that said angular displacement limiter is omitted and that the two plates C and D can rotate freely with respect to each other around the common axis of rotation and mutual coupling.

In the illustrated embodiment, the said angular displacement limiter consists of a groove 90 provided in one plate and, in this case in the plate D, and in an axial projection 80 provided on the other plate, in this case, the plate C, the groove 90 being in the form of a circular sector concentric with respect to the axis of rotation, while the projection being provided at a radial distance from the axis of rotation corresponding to that of the groove 90 so as to engage in said groove when the plate C is rotatably secured to plate D.

Said projection 80 can be a simple pin or an element in the form of a sector of a circle being concentric with respect to the axis of rotation and having radii identical to those of the groove 90.

According to another feature, the two plates can have, in the outermost radial position, a crown of ridges, or ribs or grooves 50 which modify their elastic behavior and which grooves can be further filled, all or only some of them, with a material or with combinations of different materials having a different elastic behavior in order to calibrate the elastic response also of the said plates C and D.

An advantageous embodiment provides that said plates have a reciprocal contact surface of smaller extension than the surfaces intended to rest respectively on the device and/or on a support surface such as the ground, a floor or the flooring or the like.

In this sense, the illustrated embodiment provides that the plates C and D which form the rotating support have a shape in the form of a truncated cone with an obtuse opening angle, the surfaces of mutual contact being constituted by the minor bases of said truncated cone.

Figure 12:
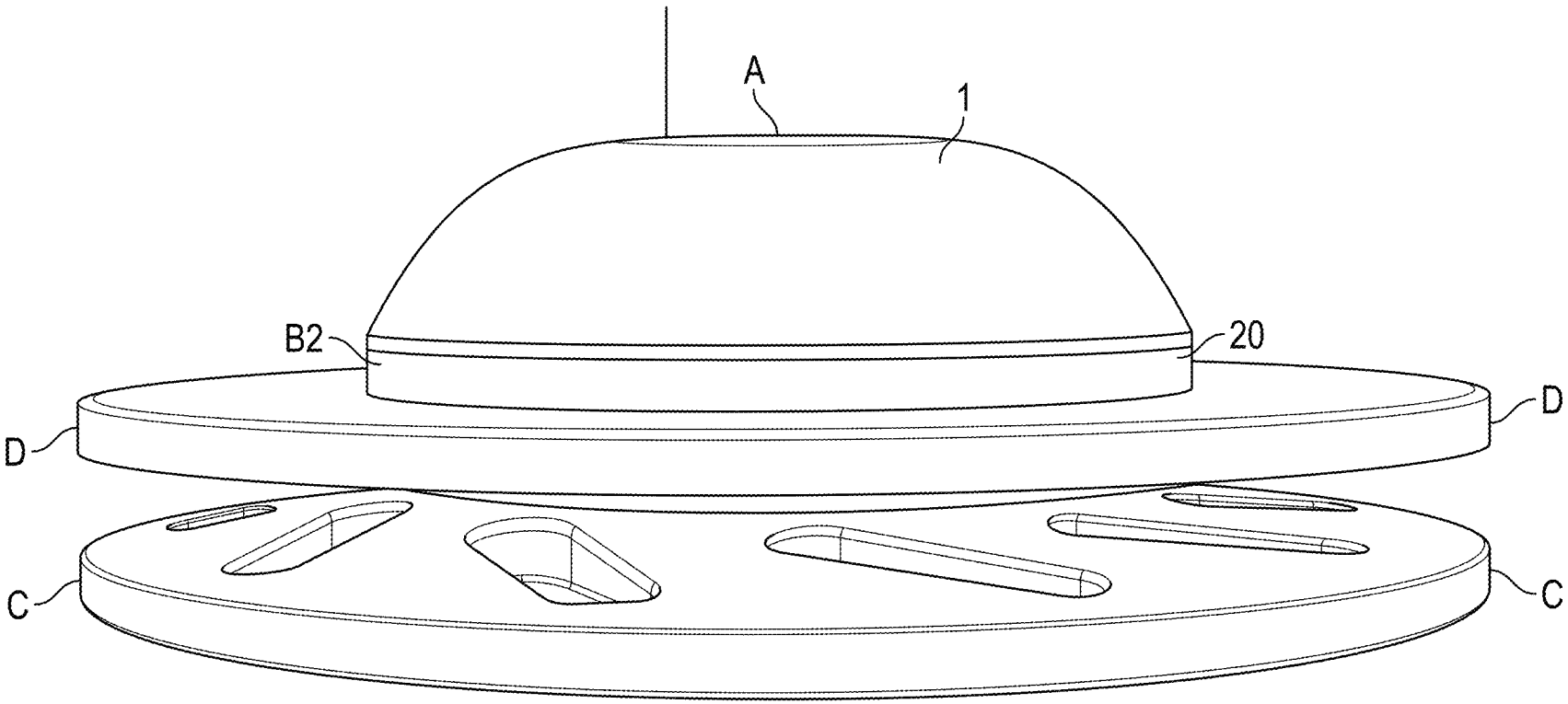
FIG. 12 shows a device according to the present invention which is composed of a combination of a dome, a male element and a rotation support constituted by the two elements according to one or more of the previous figures.

FIG. 12 shows an example of application of the rotating support in combination with a device according to the variant embodiment which comprises a dome according to FIG. 5 and a male element according to FIG. 9.

The dome A and/or the male element B2, or the base plate 20 of the same one, have a different circumference than that of the plates C and D, which, in this case, are in the shape of truncated conical discs.

The male element B2 connects the dome A to the plate D which, being fixed with a telescope screw (not shown) with the plate C, can rotate with respect to the latter and together with it also the dome A and the male element B2.

This solution, for example, can be used to improve balance, strength and mobility through the use of part A towards the subject who must rest his foot on it, thanks to proprioception by reducing the support polygon. Using the device according to FIG. 12 in an overturned position, or with the dome A resting on the ground instead of plate C, the structure would be unstable and therefore work due to instability of support.

With reference to the embodiments described above, the present device according to one or more of the previous variant embodiments, in any combination or sub-combination, can be applied to realize devices for training and/or developing the capacity for balance, muscle strength in a context of instability, and for training and developing work on joint mobility by combining the other skills. In this case a device of this type comprises at least one of the elements such as the dome and/or the male element, and/or the rotating support and/or a further dome and a coupling element which are supported with an interface such as the base side or the base plate or one of the plates of the rotating device by a support surface and on one of said elements, in particular on the dome, and/or on a base plate of a male element and/or on a plate of a rotating supporting a limb and/or an organ.

The invention, therefore, provides for an aforementioned device characterized by comprising one or more of the elements described above, such as at least a dome in one of its embodiments and/or variants described above and optionally in combination with at least one male element or a coupling element and at least a further dome according to one or more of the variants and embodiments described above, in any combination or sub-combination, and/or with at least one possible rotating support according to one or more of the embodiments and variants described above, in any combination or sub-combination.

Again, with reference to the embodiments described above, the present device according to one or more of the previous embodiments, in any combination or sub-combination, can be applied for the production of padding such as cushions, mattresses, sofas, armchairs, chairs or other such as elements for improving functionality while sitting, lying down and standing.

In this case, the invention provides a padding for a pillow, mattress, carpet or the like, which padding comprises one or more of the elements described above, such as at least a dome in one of its embodiments and/or variants described above and optionally in combination at least one male element or a coupling element and at least one further dome according to one or more of the variants and embodiments described above, in any combination or sub-combination, and/or with at least one possible rotating support according to one or more of the shapes and executive variants described above in any combination or sub-combination.

In relation to this application, but not limited to it, in particular, when the padding constitutes the support element for a relatively large surface, the invention can provide for combining with said padding an embodiment such as the one described above in which the individual devices comprising at least the domes are not separated from each other, but are joined together.

In particular, it is possible to provide a padding which comprises a device according to the present invention, which comprises a plurality of domes A each coupled to a common base plate 20 of a coupling element and arranged at least on one side of said base plate or optionally also on two opposite sides of said base plate.

According to still a possible variant embodiment, the domes A on one side of the base plate can all coincide with a dome A on the opposite side of the base plate or the domes A on one side of the base plate can all be provided offset or not coincident with the domes A on the opposite side of the base plate.

A further alternative provides that at least a part of the domes on one side of the base plate is expected to coincide and a part that does not coincide with at least a part of the domes on the opposite side of the base plate.

An embodiment can provide a padding in which the said device according to one or more of the aforementioned variants constitutes a layer of the said padding to which at least one further layer of padding material is positioned on a side thereof or superimposed.

Another executive variant of said padding can provide that said device according to the present invention constitutes an interposition layer between two layers that each overlap one face of said intermediate layer respectively and that are made of identical or different padding material.

Obviously, the number of padding layers and/or layers constituted by the device according to this variant embodiment can be greater and the relative arrangement of the layers in the stack of layers can vary according to the desired elastic and/or inelastic behavior.

A further application of the device according to the present invention relates to the field of footwear.

According to a first embodiment, the invention comprises a combination of a sole and one or more devices according to one or more of the embodiments and variants described above.

In particular, said sole comprises on the external face in contact with the ground and/or on the internal face in contact with the foot or with a sole in contact with the foot at least one or more devices according to the present invention and according to one or more of the previous embodiments or variants, which devices are provided in one or more different areas of said sole being configured in an identical or different way to exhibit different elastic behavior according to the area of the foot.

An embodiment may provide that said sole is provided in combination with one or more domes or with one or more combinations of a dome with a male element or of two domes with a coupling element, which are provided separated from each other at different points of the said sole in order to interact with different anatomical areas of the foot.

An alternative embodiment provides that said sole is constituted by a base plate of a coupling element, which base plate constitutes at least a part of the body of the sole or at least a part of a layer of material which forms the sole being long at least a part of the surface of said base plate provided with the projections for coupling to a corresponding dome and the said groups of projections being each associated with a corresponding dome distributed according to a predetermined pattern along the surface of the base plate, on one side only of the same or on both sides of said base plate.

For this embodiment it is possible to provide one or more of the variants described above with reference to the embodiments of FIGS. 7 to 9.

Thanks to the presence of one or more devices according to the present invention in a sole, depending on the configuration of the device chosen and its position with reference to the foot, it is possible to determine a support instability typical of the bare foot or, by providing domes of different sizes in the rear-foot and forefoot of the shoe, provide for the improvement of static and dynamic functionality thanks to a controlled imbalance.

According to yet another application method, the device according to one or more of the variants described with reference to the previous figures in any of the various combinations and sub-combinations described, can be used as a support for flooring as an anti-trauma and instability solution.

In sports floors, for example in basketball, one or more devices or a distribution of said devices can be provided under the wood as a buffer, or in those with heavy traffic or in those for people who work standing all day.

In this case at least the floor covering layer rests on the load-bearing rough slab by means of a distribution of devices according to one or more of the previous embodiments.

Still a further application provides that a device according to the present invention and according to one or more of the embodiments and variants described above can be used as a foot for supporting structures such as furniture, machines, chairs or the like.

In this case, the device according to the present invention can be used both to generate controlled instability and therefore to obtain a training tool, and instead to improve the adaptation of the environment to humans by having purely ergonomic functions, and also to act as a structure that absorbs mechanical and/or acoustic vibrations, as in the case of feet or platforms for supporting industrial machines for domestic use or for supporting motors or the like.

The invention claimed is:

1. A device for training a human's motoric skills, comprising:

a dome having preset characteristics of elastic deformability, the dome having a wall with preset thickness, a flat base side, an inner recess defined on a side opposite a convex side and open towards the base side, said recess being at least partially subdivided by separating walls in one or more compartments, wherein at least some of the separating walls are oriented by departing from an internal wall of the dome and extending towards the base side of the dome, or towards a plane defined by the base side, and wherein at least some of the separating walls terminate flush with the base side or with the plane defined by the base side and form ribs of support of the dome at the base side;

further comprising a male base element, the male base element comprising a base plate configured to rest against the base side of said dome, the base plate having projections protruding towards and into the recess of the dome, the projections having dimensions and shapes to cooperate with at least part of the internal wall of the dome wall and/or with the separating walls, or to be engaged by shape coupling in at least one of the one or more compartments by filling the one or more compartments completely, said base element being configured to alternately extend beyond a perimeter of the base side of the dome or to extend flush to an outer peripheral edge of the base side of the dome with a peripheral edge of the base element.

2. The device according to claim 1, wherein said dome has a top opposite to the base side, the top being shaped flattened or leveled according to a plane intersecting a curved surface of the dome.

3. The device according to claim 1, wherein said one or more compartments have a closed transversal section having different shapes along a plane parallel to the base side or the plane defined by the base side of the dome.

4. The device according to claim 1, wherein at least the dome and a distribution of the one or more compartments into which the inner recess is subdivided, have rotational symmetry in relation to a central axis perpendicular to the base side of the dome.

5. A device for training a human's motoric skills, comprising:

a dome having preset characteristics of elastic deformability, the dome having a wall with preset thickness, a flat base side, an inner recess defined on a side opposite a convex side and open towards the base side, said recess being at least partially subdivided by separating walls in one or more compartments, wherein at least some of the separating walls are oriented by departing from an internal wall of the dome and extending towards the base side of the dome, or towards a plane defined by the base side, and wherein at least some of the separating walls terminate flush with the base side or with the plane defined by the base side and form ribs of support of the dome at the base side;

further comprising, in combination with at least two domes, a coupling element of said two domes coupling the two domes being in a position opposite to each other, with their respective base sides facing each other, said coupling element having a base plate configured to close the base sides opposite to each other of the two domes and adhering against said base sides with a respective face, one or more projections branching out from each face of the base plate towards an interior of the dome, the one or more projections penetrating, at least in part, inside the recess or the compartments of the two domes and at least partially having identical shape and identical dimensions of at least one of said one or more compartments, said two domes being alternately identical in shape and/or dimensions to each other, at least in relation to the respective base side, or said two domes being different from each other as regards a shape, one or more of dimensions of the dome, walls of the dome, the separating walls of the dome, and/or the compartments in which the recesses of said domes are subdivided.

6. The device according to claim 5, wherein said base plate has a surface area greater than areas of the base sides of the domes, two or more groups of projections being provided on at least one side of said base plate or on both sides of said base plate, the two or more groups of projections being each cooperating with a different dome and being distributed according to equal or different distributions, said domes and the corresponding groups of projections being able to be all equal to each other or having different dimensions or shapes, or being at least partially equal and at least partially different.

7. A device for training a human's motoric skills, comprising:

a dome having preset characteristics of elastic deformability, the dome having a wall with preset thickness, a flat base side, an inner recess defined on a side opposite a convex side and open towards the base side, said recess being at least partially subdivided by separating walls in one or more compartments, wherein at least some of the separating walls are oriented by departing from an internal wall of the dome and extending towards the base side of the dome, or towards a plane defined by the base side, and wherein at least some of the separating walls terminate flush with the base side or with the plane defined by the base side and form ribs of support of the dome at the base side;

further comprising a rotating support coupled to the dome, the rotating support having a plurality of plates that are rotatable with respect to each other and around an axis perpendicular to said plurality of plates.

8. The device according to claim 1, wherein the device is provided alternately as a constituent element of:

a sport device and/or rehabilitation training device;

a padding for improving sitting, lying and standing functions;

a sole and/or a shoe comprising said sole, in which sole or in which shoe the device is inserted or coupled to simulate a support of a bare foot and/or to improve a static and dynamic function due to controlled imbalance;

a floor support, as an anti-trauma and instability solution, to form an intermediate support element of a coating or finishing layer of the floor between said floor and a raw slab;

a support foot of structures for pieces of furniture;

an elastic fitting or interposing element between rigid structures; or an anti-vibration and anti-noise support for structures.

9. The device according to claim 1, further comprising a rotating support coupled to the base plate, the rotating support having a plurality of plates that are rotatable with respect to each other and around an axis perpendicular to the plurality of plates.

* * * * *